United States Patent [19]

Etheridge

[11] Patent Number: 4,859,928

[45] Date of Patent: Aug. 22, 1989

[54] CMOS COMPARATOR BIAS VOLTAGE GENERATOR

[75] Inventor: Eric P. Etheridge, Beaverton, Oreg.

[73] Assignee: Tektronix, Inc., Beaverton, Oreg.

[21] Appl. No.: 287,825

[22] Filed: Dec. 20, 1988

[51] Int. Cl.[4] ..... G05F 3/24

[52] U.S. Cl. ..... 323/311; 323/314; 330/253; 330/261

[58] Field of Search ..... 330/253, 261; 323/312, 323/315, 311, 314

[56] References Cited

U.S. PATENT DOCUMENTS 4,524,329 6/1985 Abau ..... 330/261

FOREIGN PATENT DOCUMENTS 3503942 8/1986 Fed. Rep. of Germany ..... 330/261
165408 9/1983 Japan ..... 330/253
156012 9/1984 Japan ..... 330/253
232708 10/1986 Japan ..... 330/253

*Primary Examiner*—William H. Beha, Jr.
*Attorney, Agent, or Firm*—Peter J. Meza

[57] ABSTRACT

An apparatus for generating a CMOS comparator bias voltage for a CMOS comparator includes a dummy comparator having a negative input and a positive input coupled together to receive a common mode reference voltage corresponding to the common mode input voltage of the CMOS comparator. The dummy comparator also includes a bias input and an output. The apparatus for generating a CMOS comparator bias voltage further includes a bias amplifier having a negative input coupled to the output of the dummy comparator, a positive input for receiving a threshold reference voltage corresponding to the input threshold of the next stage driven by the CMOS comparator, and an output coupled to the bias input of said dummy comparator to form a comparator bias voltage.

4 Claims, 2 Drawing Sheets

CMOS COMPARATOR BIAS VOLTAGE GENERATOR

BACKGROUND OF THE INVENTION

The present invention relates to bias voltage generators and more particularly to bias voltage generators for use in CMOS comparators.

For a better understanding of the present invention, a typical CMOS comparator 10 is shown in FIG. 1. As is typical of any comparator, there is an inverting input 22, a noninverting input 20, and an output 25. This typical prior art comparator uses P channel transistors 12 and 14 as active loads for the input pair of N channel transistors 16 and 18. The bias current for the input pair of transistors 16 and 18 and active loads is provided by the drain of N channel transistor 26. The gate of transistor 26 is biased by a bias voltage designated $V_{BIAS}$. Ideally, this bias voltage is set to a voltage that enables the common mode output voltage of the comparator 10 (the output voltage that results when the positive input 20 and negative input 22 are tied together) to track the actual threshold voltage of the next stage coupled to the comparator output 25. Such a bias voltage maximizes speed and sensitivity and minimizes the input offset voltage of the comparator.

Two prior art bias generators 28 and 36 are shown in FIGS. 2 and 3. Bias generator 28 is a simple voltage divider including N channel transistors 30 and 4, both of which have the drain and gate coupled together. The bias voltage generated by bias generator 28 attempts to match the process and environmental variations experienced by transistors 16 and 26 of comparator 10 in FIG. 1. However, in actual practice, the matching is not ideal and the combination of bias generator 28 and comparator 10 in FIG. 1 results in an output voltage that is sensitive to process, environmental, and common mode voltage variations. The bias generator 36 shown in FIG. 3 has transistors 38, 30 and 34 that attempt to match transistors 12, 16 and 26 of CMOS comparator 10 in FIG. 1. The generated bias voltage at terminal 24, when coupled to CMOS comparator 10 in FIG. 1, results in an improved common mode output voltage. However, the output voltage is still sensitive to process, environmental, and common mode voltage variations.

Another prior art circuit, a comparator 46 with self generated bias voltage, is shown in FIG. 4. This comparator is identical to the prior art comparator 10 shown in FIG. 1, with the exception that the bias voltage input at the gate of transistor 26 has been coupled to the gates of transistors 12 and 14. In this way, transistor 26 is provided with an internally generated bias voltage that provides some measure of improvement in the common mode output voltage.

Bias voltage generators 28 and 36 and comparator 46 shown in FIGS. 2–4 result in a common mode output voltage that is more insensitive to common mode input voltage, process, and environmental variations than a constant bias voltage. However, the bias voltage generated by these circuits does not change in response to the input threshold voltage of the next stage driven by the comparator. What is desired is a more accurate CMOS comparator bias generator that changes in response to fluctuations in the input threshold voltage of the next stage in order that comparator speed and sensitivity are maximized and input offset voltage is minimized.

SUMMARY OF THE INVENTION

According to the present invention, an apparatus for generating a CMOS comparator bias voltage for a CMOS comparator includes a dummy comparator having a negative input and a positive input coupled together to receive a common mode reference voltage corresponding to the common mode input voltage of the CMOS comparator. The dummy comparator also includes a bias input and an output. The apparatus for generating a CMOS comparator bias voltage further includes a bias amplifier having a positive input coupled to the output of the dummy comparator, a negative input for receiving a threshold reference voltage corresponding to the input threshold of the next stage driven by the CMOS comparator, and an output coupled to the bias input of said dummy comparator to form a comparator bias voltage.

DESCRIPTION OF THE PREFERRED EMBODIMENT

Figure 5:
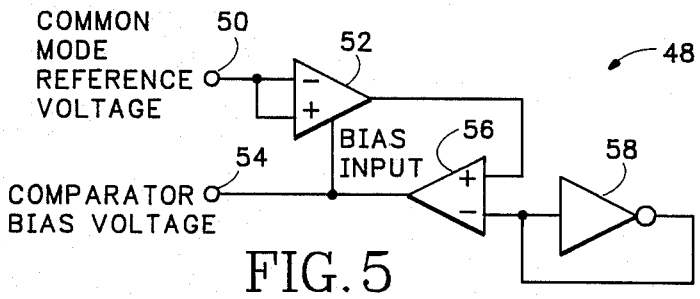
FIG. 5 is a schematic diagram of a CMOS bias voltage generator according to the present invention.

Referring to FIG. 5, a CMOS bias voltage generator 48 for a CMOS comparator (not shown and which will be subsequently referred to as "the CMOS comparator" or "the actual CMOS comparator") includes a dummy comparator 52, a bias amplifier 56, and a CMOS inverter 58. In the preferred embodiment bias generator 48 receives a common mode reference voltage at terminal 50, and generates a comparator bias voltage at terminal 54.

Bias generator 48 receives two reference input voltages. A first voltage is the common mode reference voltage coupled to terminal 50. This common mode reference voltage corresponds to the common mode input voltage of a CMOS comparator. Typically, this voltage is between 1.5 volts and 5 volts for a comparator with N-channel input transistors, and is between 0 volts and 3.5 volts for a comparator with P-channel input transistors. Ideally, the common mode reference voltage is selected to be the actual common mode input voltage of the CMOS comparator. The second reference voltage is provided by dummy CMOS inverter circuit 58. The voltage at the shorted input and output of inverter 58 corresponds to an input threshold voltage of the next stage driven by the CMOS inverter 58 is a simulation of the threshold voltage of the next stage, but other CMOS reference circuits may be used to simulate this voltage. Thus, it may be seen that the two reference voltages required by the bias generator 48 are a common mode reference voltage corresponding to the common mode input voltage of a CMOS comparator, and an input threshold voltage corresponding to the input threshold of the next stage that is driven by the output of the CMOS comparator.

FIG. 5 shows how the two reference voltages are used to provide a comparator bias voltage. Dummy comparator is used as a controlled element in the feedback path of bias amplifier 56. The output of dummy comparator 52 is compared with the simulated input threshold voltage of the next stage which is provided by dummy comparator 58. The output voltage of bias amplifier is guided by the feedback loop such that bias voltage input to dummy comparator 52 is set to a particular voltage that ensures that the output of dummy comparator 52 is equal to the input threshold voltage provided by inverter 58. Thus, an ideal comparator bias voltage is provided to bias the actual CMOS comparator.

Figure 1:
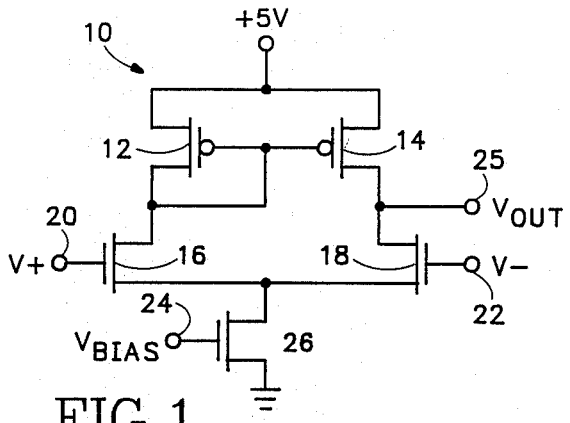
FIG. 1 PRIOR ART
FIG. 1 is a schematic diagram of a prior art CMOS comparator.
Figure 2:
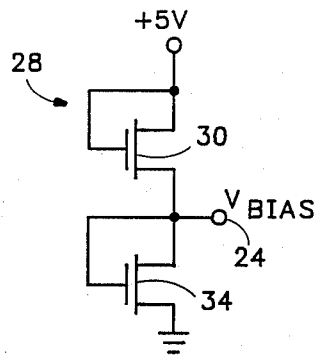
FIG. 2 PRIOR ART
FIGS. 2 and 3 are schematic diagrams of two prior art CMOS bias voltage generator circuits.
Figure 3:
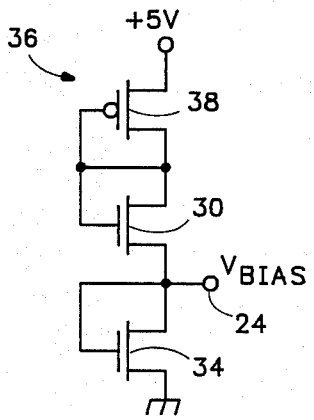
Figure 4:
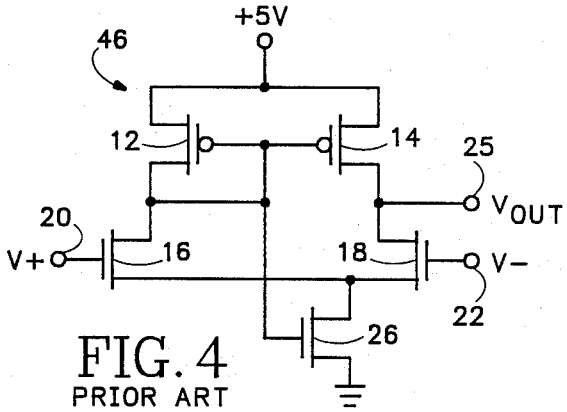
FIG. 4 PRIOR ART
FIG. 4 is a schematic diagram of a prior art CMOS comparator including a self generated bias voltage.
Figure 6:
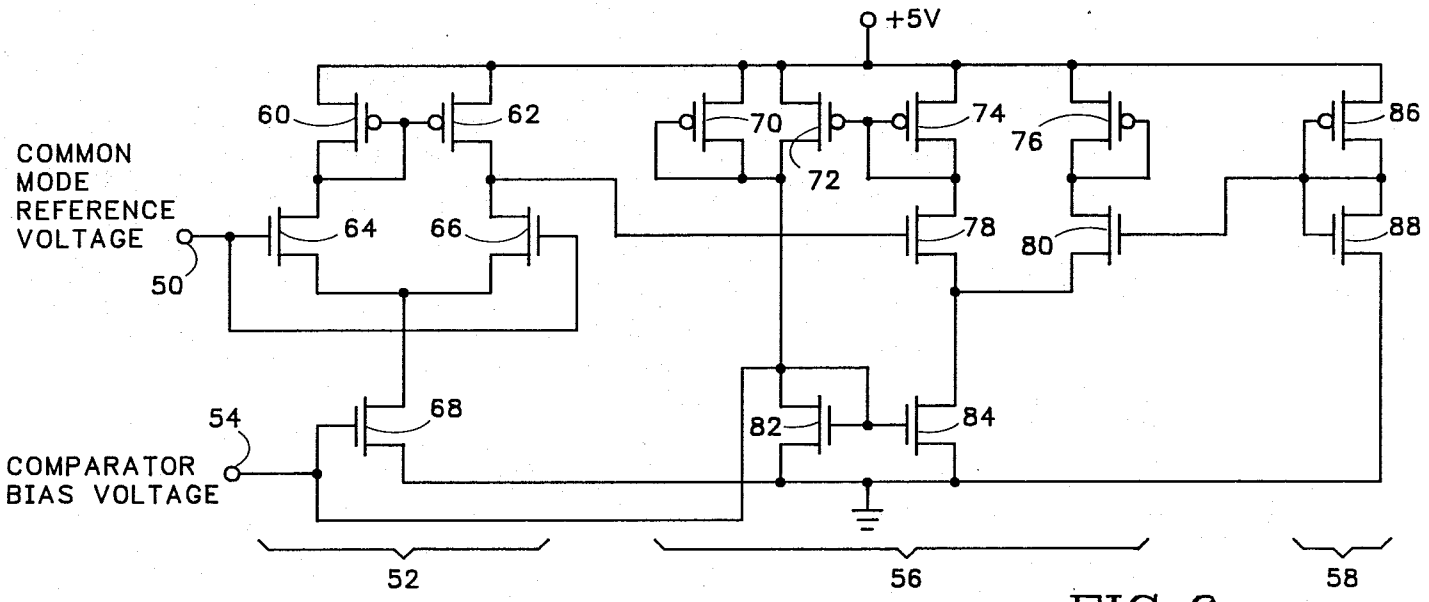
FIG. 6 is a detailed schematic diagram of a preferred embodiment of a CMOS bias voltage generator according to the present invention.

For maximum performance, it is desirable that dummy comparator 52 be matched to the actual CMOS comparator and that both comparators operate under similar conditions. The similarity of operating conditions is given by the same common mode voltage input (the common mode reference voltage at terminal 50) and the same output voltage (the input threshold voltage of the next stage simulated by inverter 58), as well as the power supplies, positive five volts and ground. Once operating conditions have been matched, it is desirable that the dummy comparator 52 be built the same orientation on an integrated circuit as the actual CMOS comparator. In this way, the comparator bias voltage generated at terminal 54 by the bias voltage generator 48, is ideal for the dummy comparator as well as the actual comparator. A more detailed schematic of bias voltage generator 48 is shown in FIG. 6. The same components, dummy comparator 52, bias amplifier 56, and inverter 58 are shown. The input, common mode reference voltage at terminal 50, and the output, comparator bias voltage at terminal 54, are the same. The dummy comparator 52 is equivalent to the prior art CMOS comparator 10 shown in FIG. 1. Transistors 64 and 66 form the input pair and transistor 68 provides the bias current for the input pair. The gate of transistor 68 also forms the comparator bias voltage at terminal 54. The CMOS inverter 58 is of conventional design having a P-channel device 86 and an N-channel device 88 being coupled together. Having the input and output tied together, the resultant voltage divider simulates the voltage found at a typical CMOS gate input.

The bias amplifier 56 is ideally suited to the bias generator 48, because the amplifier 56 does not require its own bias voltage. The bias voltage for bias amplifier 56 is self generated. Transistors 78 and 80 form a differential input pair and transistor 84 provides bias current. Transistors 72 and 74 form a current mirror active load. In conjunction with transistors 72 and 74, transistors 82 and 84 form a bias current loop that generates a bias voltage to bias the gate of transistor 84. The bias loop of transistors 72, 74, 82, and 84 has two stable states, one of which is a zero current state. To prevent the bias loop from attaining this state, a high resistance element, diode connected transistor 70, is coupled to the drain of transistor 72. In this way, a small trickle current is always provided to the bias loop, and the second stable state is always maintained. The output of the bias amplifier 56 is at the drain of transistor 72.

Thus, a CMOS comparator bias voltage generator has a dummy comparator 52 coupled to a common mode reference voltage and a bias amplifier 56 coupled to a CMOS inverter 58 to provide a CMOS comparator bias voltage. The generated bias voltage is used to drive the bias voltage input of an actual CMOS comparator such that the common mode output voltage is always at the threshold voltage of the next CMOS stage.

While I have shown and described a preferred embodiment of my invention, it will be apparent to those skilled in the art that many changes and modifications may be made without departing from my invention in its broader aspects. For example, the dummy comparator 52 and the bias amplifier 56 may be of any conventional CMOS design. Furthermore, inverter 58 may be of any other design, or a reference voltage representing the threshold voltage of the next stage may be substituted. The appended claims therefore cover all such changes and modifications as fall therewithin.

I claim:

1. An apparatus for generating a CMOS comparator bias voltage comprising:

(a) a dummy comparator having a negative input and a positive input coupled together to receive a common mode reference voltage, a bias input, and an output; and (b) a bias amplifier having a positive input coupled to the output of said dummy comparator, a negative input for receiving a threshold reference voltage, and an output to form the CMOS comparator bias voltage, the output also being coupled to the bias input of said dummy comparator.

2. An apparatus for generating a CMOS comparator bias voltage as in claim 1 further comprising a CMOS inverter having an input and an output coupled together and to the negative input of said bias amplifier to form the threshold reference voltage.

3. An apparatus for generating a CMOS comparator bias voltage as in claim 1 wherein said bias amplifier comprises:

(a) a bias voltage input; and (b) means for generating a bias voltage having a bias voltage output coupled to the bias voltage input.

4. An apparatus for generating a CMOS comparator bias voltage as in claim 1 wherein said bias amplifier comprises:

(a) a first transistor of a first polarity type having a gate forming the positive input, a drain, and a source;

(b) a second transistor of the first polarity type having a gate forming the negative input, a drain, and a source coupled to the source of said first transistor;

(c) a third transistor of a second polarity type having a gate and a drain coupled together and to the drain of said first transistor, and a source;

(d) a fourth transistor of the second polarity type having a gate and a drain coupled together and to the drain of said second transistor, and a source coupled to the source of said third transistor and to a first source of supply voltage;

(e) a fifth transistor of the second polarity type having a gate coupled to the gate of said third transistor, a source coupled to the first source of supply voltage, and a drain;

(f) a sixth transistor of the second polarity type having a gate and a drain coupled together and to the drain of said fifth transistor, and a source coupled to the first source of supply voltage;

(g) a seventh transistor of the first polarity type having a gate and a drain coupled together and to the drain of said fifth transistor to form the output, and a source coupled to a second source of supply voltage; and (h) an eighth transistor of the first polarity type having a gate coupled to the gate of said seventh transistor, a drain coupled to the source of said first transistor, and a source coupled to the second source of supply voltage.

* * * * *